US008685205B2

(12) United States Patent
Nellis et al.

(10) Patent No.: US 8,685,205 B2
(45) Date of Patent: Apr. 1, 2014

(54) FLASH TANK WITH COMPACT STEAM DISCHARGE ASSEMBLY

(71) Applicant: Andritz Inc., Glens Falls, NY (US)

(72) Inventors: Walter Edward Nellis, Queensbury, NY (US); Tyson Bradford Hunt, Saratoga Springs, NY (US); Richard M. Grogan, Queensbury, NY (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 13/908,308

(22) Filed: Jun. 3, 2013

(65) Prior Publication Data

US 2014/0034260 A1 Feb. 6, 2014

Related U.S. Application Data

(60) Provisional application No. 61/677,666, filed on Jul. 31, 2012.

(51) Int. Cl.
*D21C 11/00* (2006.01)

(52) U.S. Cl.
USPC ..... 162/29; 162/232

(58) Field of Classification Search
USPC ..... 162/29, 232; 95/260–262; 96/209–213, 96/194–197; 220/565; 62/23–31; 55/36, 55/73

See application file for complete search history.

(56) References Cited

U.S. PATENT DOCUMENTS

| | | | | |
|---|---|---|---|---|
| 4,330,307 | A * | 5/1982 | Coury | 62/618 |
| 4,511,376 | A * | 4/1985 | Coury | 95/256 |
| 7,819,976 | B2 * | 10/2010 | Friend et al. | 127/1 |
| 2009/0020480 | A1 * | 1/2009 | Hunt et al. | 210/709 |
| 2011/0139794 | A1 * | 6/2011 | Pham et al. | 220/565 |
| 2013/0206346 | A1 * | 8/2013 | Hunt et al. | 162/29 |

* cited by examiner

*Primary Examiner* — Mark Halpern
(74) *Attorney, Agent, or Firm* — Nixon & Vanderhye, P.C.

(57) ABSTRACT

A flash tank for concentrating fluids including a wall defining a rounded interior chamber bounded by a top elliptical head opposite to a bottom elliptical head; an inlet nozzle of the chamber; a steam chamber operatively engaged to the top elliptical head, wherein the steam chamber includes baffles and a conduit that directs condensate from the steam chamber to the level of liquid condensate; a gas discharge port operatively engaged to the steam chamber; and a liquid discharge port engaged to the bottom elliptical head below a vortex breaker. Changes to the flow passage of the steam chamber have been made by extending the baffles further into the internal chambers of the steam chamber.

25 Claims, 4 Drawing Sheets

FLASH TANK WITH COMPACT STEAM DISCHARGE ASSEMBLY

CROSS-REFERENCE TO PRIOR APPLICATION

This application claims the benefit of priority to U.S. App. No. 61/677,666 filed on Jul. 31, 2012, the entire contents of which are incorporated herein by reference.

BACKGROUND

The present technology generally relates to systems and methods for flash-evaporating black liquor and other liquids to increase the concentration of desirable solutes in a solvent. More particularly, the present technology relates to a pressurized vessel ("flash tank") for flash-evaporating such material.

Flash-evaporation occurs when a saturated liquid stream undergoes a rapid reduction in pressure. If the saturated liquid stream is a solution of various liquid chemicals, the reduced pressure causes chemicals with high volatility to evaporate rapidly out of the saturated liquid solution. The portion of the solution that remains in liquid form (also known as flashed liquid or flashed liquor) will invariably have an increased concentration of liquids with lower volatilities. These can be desirable solutions in many industrial processes. Flash tanks typically feature an inlet nozzle connected near the top of the flash tank. They may also have an exit port located at or near the bottom of the flash tank. Flashed liquid that remains after the flash evaporation may exit through this exit port.

Industrial flash tanks are generally used to flash-evaporate a high pressure liquid stream to produce a steam stream and a flashed liquid stream. These flash tanks typically have a high pressure inlet nozzle that communicates the high pressure liquid stream to the interior of the tank. They also typically feature an upper steam recovery system with a gas discharge port, and a liquid discharge port. Steam recovery systems may employ additional components. Flash tanks safely and efficiently reduce pressure in a pressurized liquid stream, thereby allowing recovery of heat energy (steam) from the flashed liquid stream. They may also be used to concentrate chemicals in the flashed liquid stream.

In practice, a high pressure liquid stream usually flows through the inlet nozzle and is either sprayed against a deflector plate of various shapes or along the wall of the flash tank. The percentage of volatile chemicals that flash-evaporate from the high pressure liquid stream increases upon exposure of the chemicals to the low pressure environment. As such, many conventional flash tanks utilize inlet nozzles to spray the incoming high pressure liquid stream in a uniform direction along the inner flash tank walls to increase the incoming high pressure liquid stream's exposure to the low pressure environment as it spirals downward toward the level of flashed (condensed) liquid. Consequently, the flashed liquids at the bottom of the flash tank tend to spin in a uniform direction. A vortex breaker is usually employed to disrupt this spinning at the bottom of the flash tank to facilitate the exit of flashed liquid from the flash tank.

One problem with large scale flash-evaporation equipment is that traditional inlet nozzles force the incoming high pressure liquid stream to converge to a point as they eject the high pressure liquid stream along the inner vessel wall. The resulting collision of the high pressure liquid stream with the inner flash tank wall causes disruption in the formation of the uniform flow on the inner chamber wall, thus reducing the amount of volatile liquid extracted from the high pressure liquid stream.

Large scale flash tanks suffer from another problem: a small portion of desirable low-volatility chemicals may condense around high volatility chemicals in the steam. In industrial processes, this can lead to a significant loss in desirable product, increased operating costs, and increased release of harmful chemicals into the environment. As such, many industrial flash tanks feature steam recovery systems to process or repurpose the steam. This steam may be utilized as heat energy in other stages of the process, or it may be discharged in the appropriate manner.

Flash tanks are common pieces of equipment in many chemical industrial processes. They can be used in batch or continuous chemical manufacturing processes. Pulp and paper production and biomass treatment are typical industrial processes utilizing one or more flash tanks to recover steam from hot high pressure liquid process streams produced by treating comminuted cellulosic fibrous material, lignocellulose, or other such material.

Flash tanks may be used to recover chemicals from chemical pulping systems, such as sulfur, soda, or Kraft cooking systems. To produce pulp from wood chips or other comminuted cellulosic fibrous organic material (collectively referred to herein as "cellulosic material"), the cellulosic material is mixed with liquors, e.g., water and cooking chemicals, and transferred to a pressurized treatment vessel ("digester"). Sodium hydroxide, sodium sulfite, and other alkaline chemicals are used to "cook" the cellulosic material in a Kraft cooking process. Other cooking processes, for example, the soda cooking process, may use alkaline chemicals free of sulfur.

These cooking chemicals and many combinations thereof are known in the pulp and paper industry as white liquor. As the white liquor contacts the cellulosic material, it begins to degrade lignin, hemicellulose and other compounds in the cellulosic material. The white liquor quickly incorporates dissolved organic compounds and becomes black in color and may be referred to as "black liquor" or even "spent cooking liquor". As such, spent cooking liquor is commonly referred to as "black liquor" in the industry. The Kraft cooking process is typically performed at temperatures in a range of 110° C. to 180° C. and at pressures substantially greater than atmospheric. The soda cooking process may be preformed at higher temperatures and pressures than the Kraft cooking process.

Cooking digesters may be batch or continuous flow vessels. They are generally vertically oriented and may be sufficiently large to process 1,000 tons or more of cellulosic material per day, wherein the material remains in the vessel for several hours. In addition to a Kraft, soda, or sulfur digester, a conventional pulping system may include other pressurized reactor vessels for impregnating the cellulosic material with white liquor, or black liquor, prior to the cooking in a digester. In view of the large amount of cellulosic material in the impregnation and cooking stages, a large volume of black liquor tends to be extracted from these pressurized reactor vessels.

The black liquor includes the cooking chemicals (such as residual alkali) and organic chemicals (such as organic acids), as well as dissolved organic materials e.g. lignin, hemicellulose, and other organic materials dissolved from the cellulosic materials. Removing some of the black liquor containing a high volume of dissolved organic materials at various stages of the pulping process has been found to increase various pulp properties including tensile strength. This has been disclosed in U.S. Pat. No. 5,489,363. In the pulping process, flash tanks are used to produce steam from hot process liquids, hot high pressure liquid streams, such as black liquor which results in concentrating the dissolved organic material in the resulting flashed black liquor (may also be referred to as concentrated black liquor). The flashed black liquor leaving the flash tank is at a lower pressure than the hot high pressure liquid stream entering the flash tank. This flashed and concentrated black liquor can be used for further processing, such as in the evaporation and recovery parts of the mill where chemicals are recovered and dissolved solids can be used as a fuel to create energy, or for use in another stage of the pulping process.

The black liquor is flash-evaporated in a flash tank to generate steam and flashed liquid. The cooking chemicals and organic compounds are included with the flashed liquid formed when the black liquor is flashed. The steam formed from flash-evaporation is generally free of condensable chemicals and organic compounds, but could contain non-condensable gas such as hydrogen sulfide, etc. Steam produced by flash-evaporation of the high pressure liquid stream from the pulping process may be used as heat energy in the pulping process, that is, returned to the pulping process as heat energy.

In conventional flash tanks with an integral steam chamber, a portion of the steam chamber is substantially engaged with the circumference of the flash tank. The remainder of the steam chamber tends to be recessed, thereby creating a cavity above the interior chamber. This cavity has been used to reclaim condensable liquids such as black liquor for reuse in the cooking process; however the fact that the steam chamber is substantially engaged to the circumference of the flash tank reduces the surface area along which the high pressure liquid stream may travel down into the flashed liquid below.

The interior of the steam chamber usually contains a series of baffles designed to create a tortuous path for the exiting steam and thereby reduce loss of condensable liquor. As steam passes through a convoluted internal path, the corrosive nature of the black liquor and the high pressures contained within the flash tank causes damage to the tank or causes deposits on the interior of the tank, thereby requiring periodic maintenance to repair and clean the flash tank. As such, the extent to which baffles could extend into internal chambers of the steam chamber is limited by the need to make all areas of the steam chambers wide enough for human admittance. In order to meet the requirement of the steam chambers being wide enough for human admittance, the steam chambers are thereby prevented from extending the baffles to be overlapping within the internal chambers of the steam chamber and thus limiting the surface area of the tortuous path for the exiting steam and thereby allowing for the loss of condensable liquor to exit with the steam.

Accordingly, there is a need for an improved steam chamber that will improve the condensable liquid recovery in the steam chamber without requiring admittance of a person for manual inspection. It is to these and other needs that the present technology is directed.

Conventional flash tanks also generally have inverted conical bottoms. These bottoms facilitate rotational movement of the flashed black liquor and also limit the surface area of the flash tank wall that can be used for conveying flashed black liquor or other flashed liquids to the liquid at the bottom of the flash tank. Traditional conical bottoms may also employ a vortex breaker to disrupt the rotational movement of the flashed black liquor before allowing it to exit through a discharge port at or near the bottom of the flash tank. Accordingly, there is a need for an improved design that will increase the surface area of the flash tank's interior wall without disrupting the continuous flow of flashed black liquor out of the flash tank.

SUMMARY OF THE TECHNOLOGY

A flash tank has been conceived that may comprise: at least one wall defining a rounded interior chamber bounded by a top elliptical head opposite to a bottom elliptical head; an inlet nozzle operatively engaged to the rounded interior chamber of the flash tank; a steam chamber that may comprise: a gas inlet nozzle, an upper steam chamber operatively engaged to bottom of the elliptical head of the top of the flash tank chamber, and a lower steam chamber that may be contiguous with the upper steam chamber. The upper steam chamber may have a steam inlet port that communicates with the rounded interior chamber. The lower steam chamber may comprise: an area defining an open space between the upper steam chamber and the lower steam chamber, the lower steam chamber may include a plurality of partially overlapping baffles operatively engaged to at least one wall defining the lower steam chamber, an angled floor operatively engaged to the at least one wall defining the bottom of lower steam chamber, and a conduit with a first end engaged to the angled floor and a second end engaged to the vortex breaker located below the lower steam chamber that directs condensate from the steam chamber to the level of flashed liquid in the bottom of the flash tank. The lower steam chamber may also include a gas discharge port operatively engaged with the lower steam chamber and a hatch operatively engaged to the angled floor defining the bottom of the lower steam chamber. The flash tank may also include a liquid discharge port engaged to the bottom elliptical head. A vortex breaker, whose center may be located above this discharge port within the flash tank, the vortex breaker operatively engaged to the bottom elliptical head of the flash tank.

Changes to the flow passage of the steam chamber have been made by extending the baffles further into the internal chambers of the lower steam chamber, such that the length of the baffles is between 50 percent and 90 percent (55 percent to 75 percent according to one example of the technology) of the width of the annular steam flow passage area of the lower steam chamber that may be defined between the interior of the steam chamber and the exterior of the steam inlet port. Changes to the overall surface area of the flash tank have been made by replacing an inverted conical bottom with the bottom elliptical head and engaging a vortex breaker operatively to the bottom elliptical head.

The flash tank receives a high pressure stream of black liquor or other high pressure liquid stream from an inlet nozzle tangentially engaged to an upper portion of the flash tank. The high pressure stream of black liquor or other high pressure liquid stream ejected from the inlet nozzle transverses the cylindrical wall of the flash tank before collecting in the rounded bottom of the flash tank. In another example of the technology, the inlet nozzle may extend into the flash tank to provide the high pressure stream of black liquor into the flash tank.

The high pressure stream of black liquor entering the flash tank may comprise sodium hydroxide, sodium sulfite, other alkaline chemicals, dissolved organic materials, un-dissolved solid organic material, or a combination thereof. This high pressure stream of black liquor or other high pressure liquid stream may flow into the flash tank continuously or in batches provided the high pressure stream of black liquor or other high pressure liquid stream enters the flash tank at a higher pressure than the pressure inside the flash tank. The high pressure stream of black liquor or other high pressure liquid stream has a retention period in the pressurized flash tank, the retention period may be selected based on the type of high pressure liquid stream processed in the flash tank.

As the high pressure stream of black liquor or other high pressure liquid stream enters the lower pressure flash tank, the more volatile chemicals in the stream will evaporate rapidly thereby concentrating the less volatile liquids and dissolved organic materials in the remaining liquid. By traveling along the cylindrical walls of the flash tank, the high pressure stream of black liquor or other high pressure liquid stream has increased exposure to the lower pressure environment. This increases the amount of time that volatile chemicals are exposed to the low pressure environment of the flash tank and so increases the amount of volatile chemicals that may be effectively evaporated into the steam stream from the high pressure liquid stream entering the flash tank.

The elliptical heads and the centrally located steam chamber increase the surface area of the flash tank wall along which the high pressure stream of black liquor or other high pressure liquid stream may flash-evaporate as it is ejected from the inlet nozzle. The increased surface area permits more contact with the inner chamber wall and thereby increases the high pressure stream of black liquor's exposure to the flash tank's low pressure environment.

The elliptical head at the bottom of the flash tank also includes a liquid discharge port located under a vortex breaker. The vortex breaker disrupts the rotational movement of the flashed black liquor and facilitates the release of such liquor from the liquid discharge port. Flashed black liquor or other flashed liquid may flow through this liquid discharge port at the conclusion of the flash-evaporation process. This flashed black liquor may be used in other stages of the chemical manufacturing process. For example, it may be used to pretreat wood chips or other sources of raw cellulosic material in preparation for the cooking process.

This example also utilizes a steam chamber that is operatively engaged to the roof of the flash tank but is disengaged from the flash tank's inner walls. This also increases the surface area of the flash tank and may permit repositioning of the inlet nozzle to take advantage of this increased surface area.

A steam chamber operatively engaged to the roof of the flash tank has been conceived, the steam chamber may include a steam input port that accepts flash-evaporated steam from the flash tank, and an upper steam chamber that directs steam from the input port through an opening into a lower steam chamber. This lower steam chamber defines an annular space that contains overlapping baffles. These overlapping baffles create a tortuous path for the exiting steam. Exiting steam may exit through a gas discharge port after it passes through the tortuous path. The lower steam chamber may also contain an angled floor that permits the collection of condensed steam and a conduit that directs re-condensed liquid from the steam chamber to the level of liquid at the bottom of the flash tank for discharge through the liquid discharge port. Because the steam chamber may be recessed from the walls of the flash tank, it may be smaller than the overall circumference of the flash tank. This smaller design permits increased overlap of internal baffles, thereby creating a more tortuous path for the steam and promotes removal of entrained liquor droplets from the steam created by the flashing of the high pressure liquor entering the flash tank.

As flash-evaporated steam enters the steam input nozzle, it enters the upper steam chamber. Once in the upper steam chamber the steam proceeds to the lower steam chamber where it comes into contact with the series of overlapping baffles that create the tortuous exit path for the steam. The steam may contain entrained droplets of liquor. It is desirable to reintegrate these entrained droplets into the flashed black liquor below to reduce carryover of black liquor with the steam which results in operational upsets and increased associated operating costs. As steam contacts the baffles, the entrained droplets of liquor condense out of the steam and flow down to the floor of the steam chamber. The lower steam chamber's sloped floor permits gravity to collect the re-condensed liquid and direct it toward a conduit that conveys the liquid from the steam chamber to the level of flashed liquid below.

The steam chamber's compact design also permits visual inspection from a hatch that may be included in the floor or wall of the lower steam chamber. This alleviates the need to admit a human inspector into the steam pathway. As a result, the baffles may overlap in an annular space to create a more tortuous path for the steam thereby causing more steam to interact with the baffles to promote the removal of entrained liquor droplets.

A method has been developed for flash-evaporating a high pressure liquid steam. The method may involve introducing the high pressure liquid stream to a pressurized vessel, the pressurized vessel having a lower pressure than the high pressure liquid stream, as the high pressure liquid stream enters the pressurized vessel, a steam stream and a flashed liquid stream is formed, wherein the steam stream enters a tortuous path caused by overlapping baffles increasing the amount of time volatile chemicals in the high pressure liquid stream entering the pressurized vessel are exposed to the low pressure environment of the pressurized vessel thereby increasing the amount of volatile chemical evaporated from the high pressure liquid stream. After passing through the tortuous path caused by overlapping baffles, the steam stream exits the pressurized vessel through the gas discharge port, and the flashed liquid stream formed is discharged from the flash tank through the liquid discharge port.

The high pressure liquid stream entering the pressurized vessel may be high pressure black liquor from a pulping process. The liquid stream formed from the high pressure liquid stream entering the pressurized vessel may be a flashed liquid stream containing condensed volatile chemicals and re-condensed liquid from a steam chamber within the pressurized vessel. This flashed liquid stream contains entrained droplets of liquor from the steam stream. The pressurized vessel used in this method may be a flash tank.

Another example of the technology is directed to a flash tank that may comprise: an interior chamber defined by at least one wall; a steam chamber supported within the interior chamber, said steam chamber separated from the at least one wall by a distance; a steam inlet port to direct gas from the interior chamber into the steam chamber; and a gas discharge port to discharge gas from the steam chamber.

In examples, (a) said steam chamber may comprise an upper steam chamber, a lower steam chamber, a partition to separate the upper steam chamber and the lower steam chamber, and a lower steam chamber inlet port in the partition to allow gas to flow from the upper steam chamber to the lower steam chamber, (b) said steam inlet port may connect the interior chamber to the upper steam chamber, (c) said gas discharge port may be connected to the lower steam chamber to discharge gas from the steam chamber, (d) said lower steam chamber may define a path between the lower steam chamber inlet and the gas discharge port, (e) said lower steam chamber may comprise a plurality of baffles, each of said plurality of baffles extending into the path at least half of a width of the path, (f) each of said plurality of baffles may extend into the path up to ninety percent of the width of the path, (g) said plurality of baffles may be arranged annularly within the lower steam chamber, (h) said path may be defined by opposing walls of the lower steam chamber and said plurality of baffles may extend from the opposing walls in an alternating pattern, (i) said lower steam chamber may comprise an angled floor, (j) the flash tank may comprise a conduit having a first end in communication with the angled floor of the lower steam chamber, (k) at least one of said plurality of baffles is attached to the lower steam chamber inlet port, each having at least one hole and/or notch to allow fluid communication therethrough to the first end of the conduit, and/or (l) said lower steam chamber may comprise a hatch located on the angled floor.

Further areas of applicability will become apparent from the description provided herein. It should be understood that the description and specific examples are intended for purposes of illustration only and are not intended to limit the scope of the present disclosure.

These features, and other features and advantages of the present technology will become more apparent to those of ordinary skill in the art when the following detailed description of the various examples of the technology is read in conjunction with the appended figures.

BRIEF DESCRIPTION OF THE DRAWINGS

The foregoing will be apparent from the following more particular description of example examples of the technology, as illustrated in the accompanying drawings in which like reference characters refer to the same parts throughout the different views.

DETAILED DESCRIPTION

The foregoing detailed description of examples of the present technology is presented only for illustrative and descriptive purposes and is not intended to be exhaustive or to limit the scope and spirit of the technology. The examples were selected and described to best explain the principles of the technology and its practical applications. One of ordinary skill in the art will recognize that variations can be made to the technology disclosed in this specification without departing from the scope and spirit of the technology.

A flash tank has been conceived comprising: an interior chamber with elliptical heads; an approach mechanism, and an inlet nozzle attached to the interior chamber, wherein the flow area of the inlet nozzle may be varied to allow for control of the inlet area without changing the physical or mechanical components of the inlet nozzle or flash tank. The flash tank also comprises a steam chamber operatively engaged to the top internal wall of the flash tank, wherein the steam chamber comprises a gas inlet port, an upper steam chamber, and a lower steam chamber that may be contiguous with the upper steam chamber. The lower steam chamber may direct steam from the upper steam chamber through an area comprising partially overlapping baffles that define a tortuous path. The steam chamber also contains a gas discharge port operatively engaged to one end of the tortuous path. The lower steam chamber also contains a roof; a sloped floor; a conduit engaged to the sloped floor at one end and to a vortex breaker at the opposite end that directs flashed liquid from the lower steam chamber to the liquid collection region within the bottom of the flash tank; and a liquid discharge port engaged to the bottom elliptical head of the flash tank.

A lower steam chamber for a flash tank has been conceived where the flow area of the lower steam chamber is made more tortuous by increasing the extent to which internal baffles extend into the flow area. These baffles have end points that may partially overlap relative to an imaginary reference point within the lower steam chamber. For example, these baffles may be annularly arranged along opposing walls of the lower steam chamber so that their end points partially overlap relative to an imaginary circumference in the center of the tortuous pathway. The end points of the baffles may overlap partially because the new design alleviates the need to admit a human inspector. Previous steam chambers did not allow for partially overlapping baffles because the annular space of the steam chamber needed to be sufficiently wide to admit a human inspector for periodic assessment and maintenance.

Figure 1:
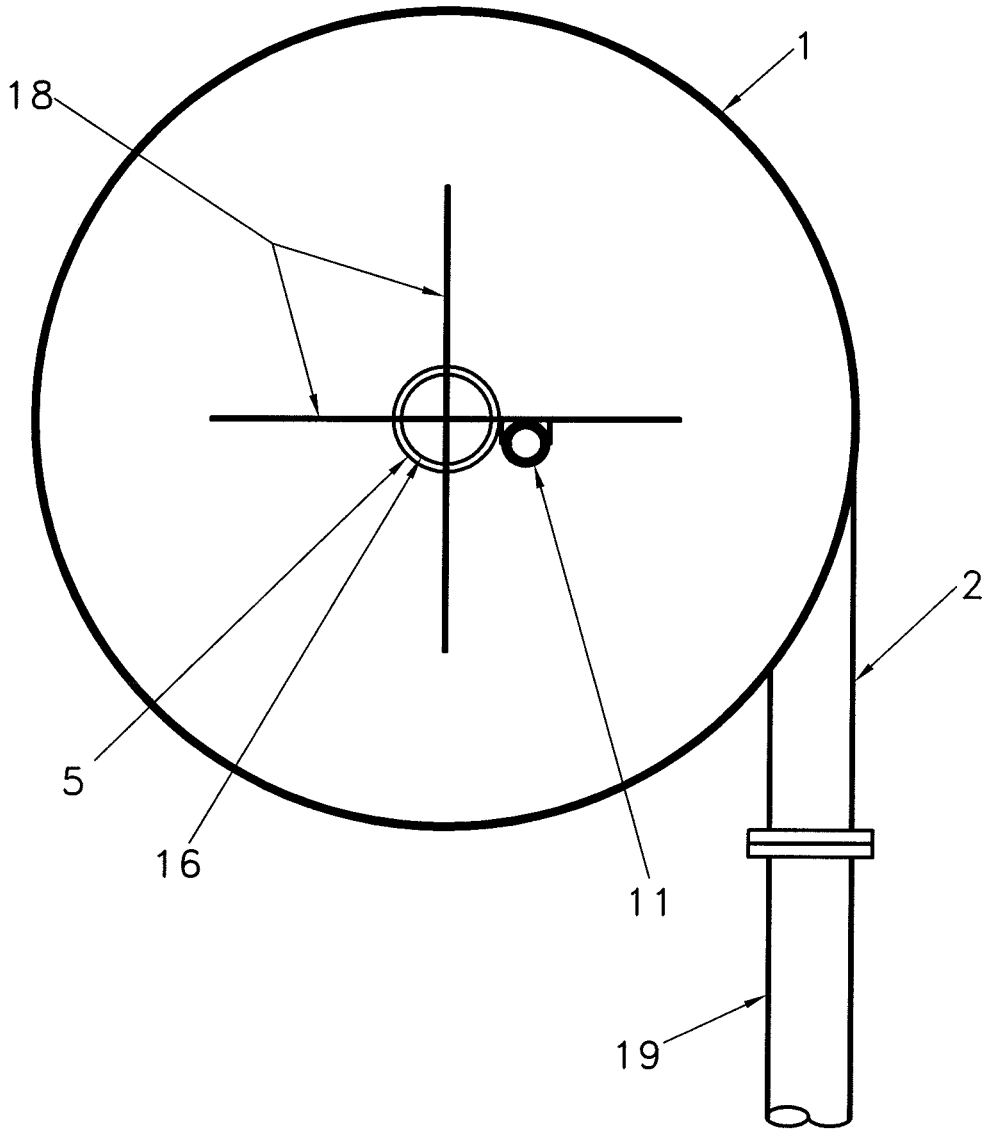
FIG. 1 is a cross-sectional view of the flash tank taken through line 1-1 of FIG. 2, wherein the inlet nozzle is attached to the tank along a tangent to the tank.
Figure 2:
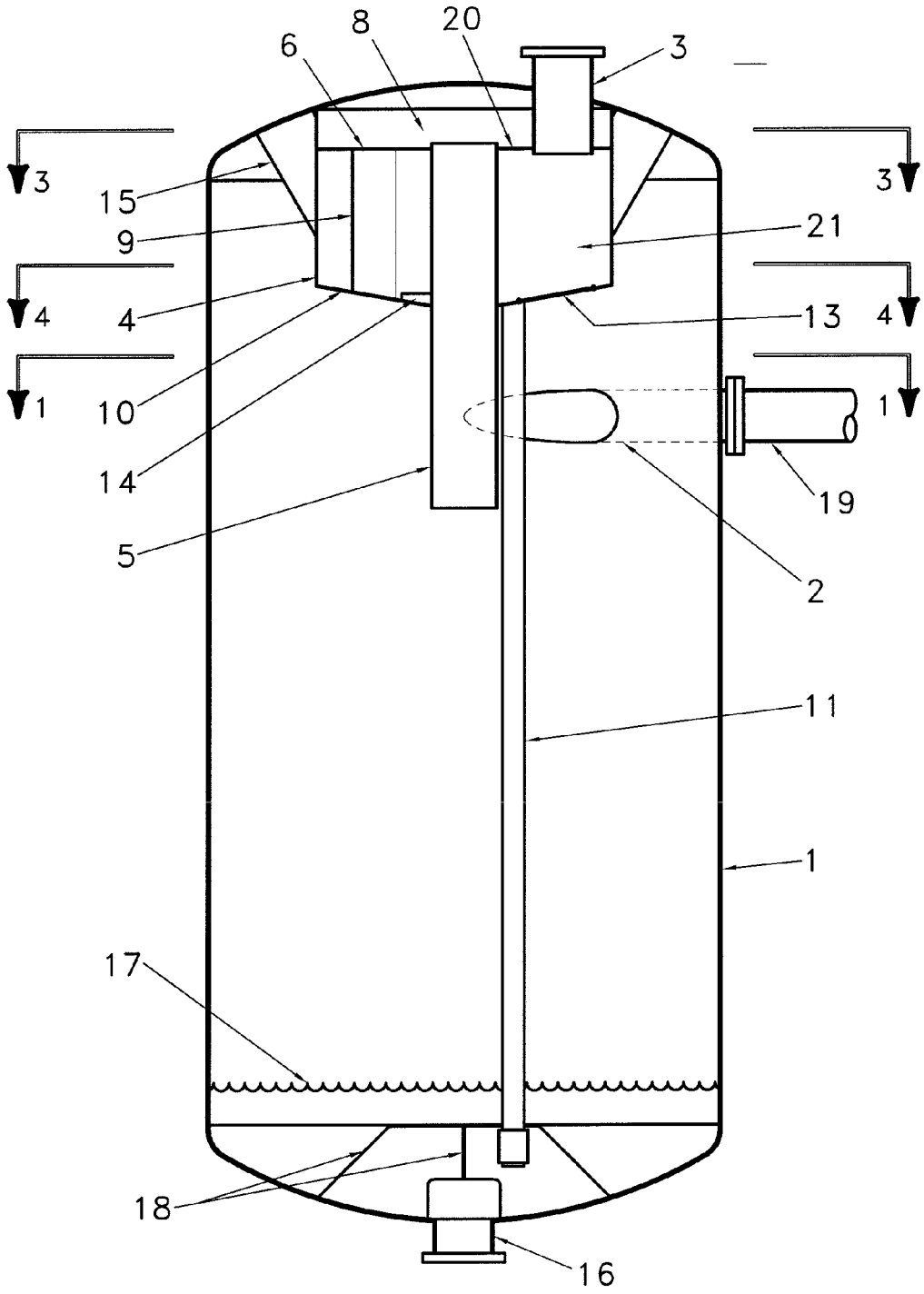
FIG. 2 is a cross sectional view of the flash tank taken along a vertical plane to show the steam chamber affixed to the top upper internal wall of the flash tank and the inlet nozzle tangentially engaged near the top of the flash tank.

FIG. 1 is a cross-sectional view of an exemplary flash tank 1 taken through line 1-1 in FIG. 2, wherein the inlet nozzle 2 is tangentially attached to the flash tank 1. This figure illustrates the inlet approach mechanism 19, vortex breaker 18, liquid discharge port 16, and internal reclamation conduit 11. The gas discharge port 3 (shown in FIG. 2) is affixed to the top of the flash tank 1. Steam exiting the tortuous path 12 (shown in FIG. 4) may exit out the gas discharge port 3 for use in other parts of the pulp and paper manufacturing process or it may be released using proper methods as a waste product. The flashed steam inlet port 5 is also shown in fluid communication with the flash tank 1, as further depicted in FIG. 2.

It should also be understood that in another example of the present technology that the inlet nozzle may extend into the flash tank to provide the high pressure stream of black liquor into the flash tank.

The exemplary flash tank 1, and inlet nozzle 2, may be constructed from metals including but not limited to steel, stainless steel, aluminum, or a combination thereof.

FIG. 2 is an exemplary cross sectional view of the flash tank 1 taken along a vertical plane to show a steam chamber 4, which may be affixed to the upper elliptical head of the flash tank with supporting gussets 15. The inlet approach mechanism 19 and inlet nozzle 2 may be tangentially engaged near the top of the flash tank 1. As discussed above, another example of the technology may include the inlet nozzle 2 being extended into the flash tank 1.

As the high pressure black liquor or other high pressure liquid stream enters the flash tank 1, the liquor flash evaporates to produce steam and flashed liquid. The steam may be used as heat energy elsewhere in the pulping process. For example, this heat energy may be used in, but is not limited to use in, a chip feed bin, chip steaming vessel, or a heat exchanger for cooking liquor, e.g., white liquor, green liquor, or black liquor. Portions of the steam that condense upon contact with baffles 9 (shown in FIG. 4) within the tortuous path 12 may be reclaimed within the steam chamber 4. These flashed liquids may be directed toward the level 17 of flashed black liquor or other flashed liquid at the bottom of the flash tank 1 via an internal reclamation conduit 11. The flashed black liquor or other flashed liquid may flow out of the liquid discharge port 16 and be recycled for use in other parts of the manufacturing process. For example, it may be used to impregnate raw cellulosic material in a pretreatment stage prior to cooking. It may also be used in a process in which the flashed black liquor or other flashed liquid is further concentrated or fractionated.

As the high pressure stream of black liquor flashes in the flash tank 1 to form steam and flashed black liquor, the steam flows into a steam inlet port 5 of the steam chamber 4. By forming and locating the steam chamber 4 as shown in the drawings and discussed herein it may be possible to take advantage of a larger amount of the interior surface area of the flash tank 1 for flashing the black liquor. For example, FIG. 2 shows the steam chamber 4 separated from the interior wall(s) by the supporting gussets 15. The steam chamber 4 may be constructed out of materials including but not limited to steel, stainless steel, titanium, aluminum, or a combination thereof. The steam may then flow through the upper steam chamber 8 where it collects and moves through a lower steam chamber inlet port 6 to the lower steam chamber 7, which includes baffles 9 and the tortuous path 12. A lower steam chamber roof 20 may be included to separate the upper steam chamber 8 from the lower steam chamber 7. The lower steam chamber inlet port 6 may be formed through the lower steam chamber roof 20 to allow for the passage of steam from the upper steam chamber 8 to the lower steam chamber 7. The steam then circles almost $360^2$ in the tortuous path 12 before reaching the gas discharge port 3. A separation plate 21 may also be provided to separate the lower steam chamber inlet port 6 and the gas discharge port 3 to further define the beginning and the end, respectively, of the tortuous path 12. The separation plate 21 may help to direct the steam out of the lower steam chamber 7 via the gas discharge port 3 once it has traveled along the tortuous path 12. While the steam is in the tortuous path 12, it interacts with a series of baffles 9. These baffles 9 capture condensable liquids from the steam. These liquids may include dissolved organic materials or chemical components of the black liquor such as but not limited to sodium hydroxide.

The condensate may flow as a liquid down the angled floor or base 10 to the center of the bottom of the steam chamber 4, lower steam chamber 6 is located completely within steam chamber 4 such that the angled floor or base 10 of lower steam chamber 7 may also be the angled floor or base 10 of the steam chamber 4. Some of the baffles 9, such as those attached to steam inlet port 5, may feature at least one hole and/or notch 14 which directs the flashed liquids toward an internal reclamation conduit 11 operatively engaged to the angled floor or base 10 of the steam chamber 4 on a first end and a second end engaged to the vortex breaker 18. The internal reclamation conduit 11 may direct the condensate down through the flash tank 1 toward the level 17 of flashed black liquor at the bottom of the flash tank 1 and is engaged with the vortex breaker 18. The internal reclamation conduit 11 may be cylindrical and it may be made of materials that include but are not limited to steel, stainless steel, titanium, aluminum, or a combination thereof.

Figure 3:
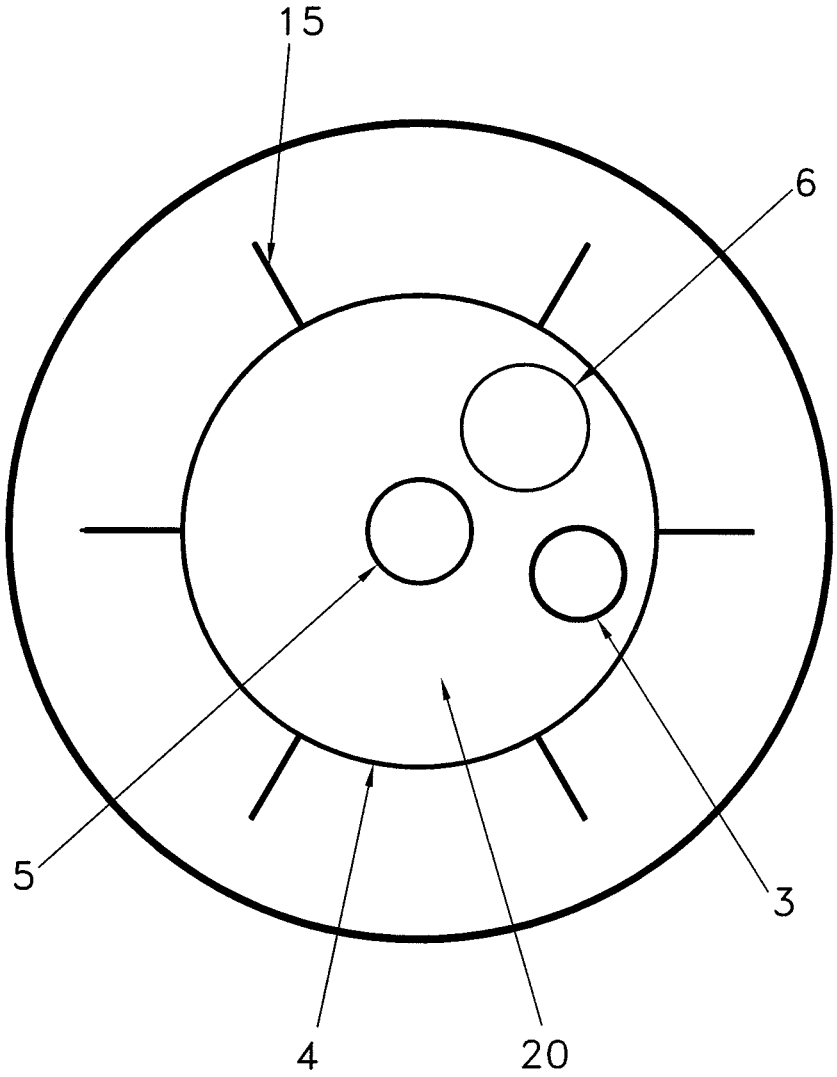
FIG. 3 is a cross-sectional view of the upper steam chamber taken through line 3-3 of FIG. 2 to illustrate the steam inlet and exhaust ports.

FIG. 3 illustrates an exemplary cross-sectional view of the upper steam chamber 8 (shown in FIG. 2) taken through line 3-3 of FIG. 2 to illustrate the steam inlet port 5, the lower steam chamber inlet port 6, and the gas discharge port 3. Supporting gussets 15 support the steam chamber 4.

Figure 4:
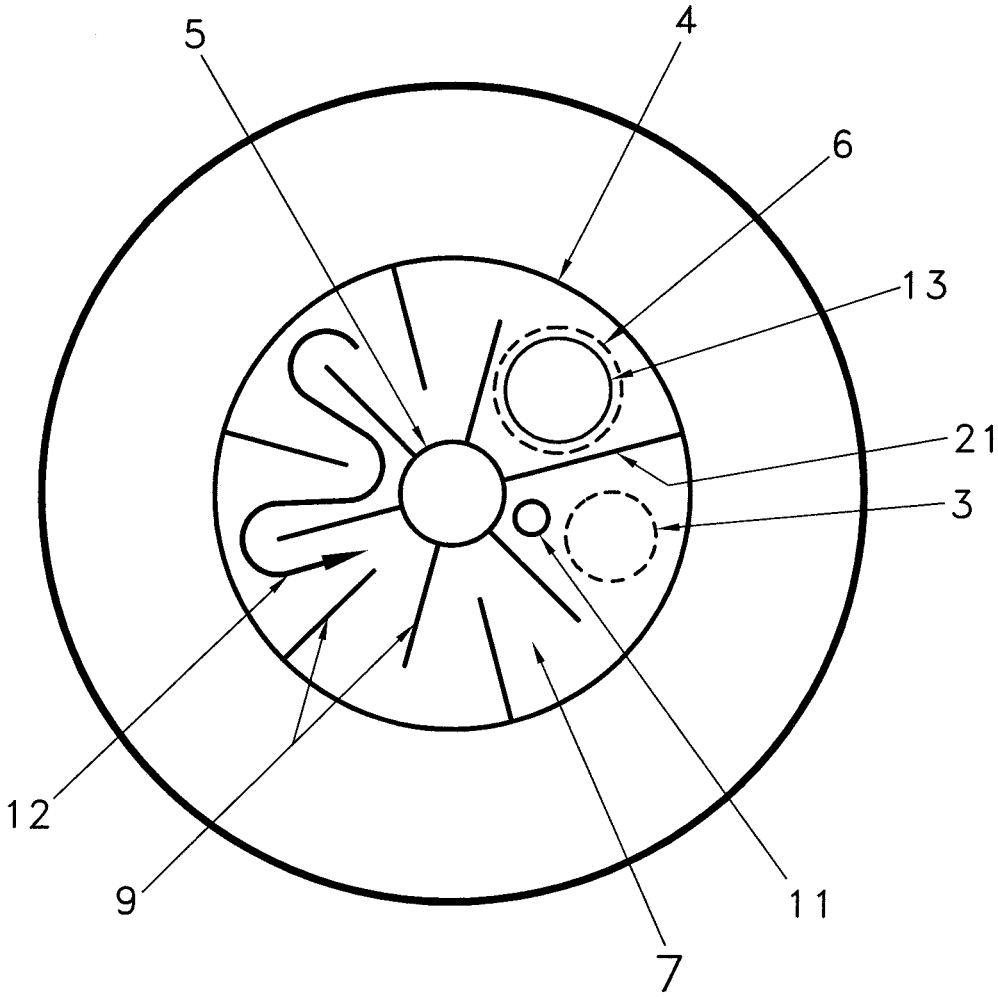
FIG. 4 is a cross-sectional view of the lower steam chamber taken through line 4-4 of FIG. 2 to illustrate the lower steam inlet port, the hatch for visual inspection, the baffles, the separation plate and the conduit directing the condensate to the liquid level.

FIG. 4 is an exemplary cross-sectional view of the steam chamber 4 taken through line 4-4 of FIG. 2. This view shows the internal reclamation conduit 11 directing the condensate to the liquid level at the bottom of the flash tank. This view shows the tortuous path 12 for the steam, the baffles 9 which may be arranged along opposite walls in an alternating manner to create a tortuous path 12 for the steam. As steam engages the baffles 9, the condensable liquids collect and fall to the angled floor or base 10 of the steam chamber 4. The angled floor or base 10 engages an internal reclamation conduit 11 into which the flashed liquids flow. The internal reclamation conduit 11 conveys the flashed liquids to the level 17 of flashed black liquor or other flashed liquid at the bottom of the flash tank 1.

Also, as discussed above, a separation plate 21 may be provided to separate the lower steam chamber inlet port 6 and the gas discharge port 3 to further define the beginning and the end, respectively, of the tortuous path 12. The separation plate 21 may help to direct the steam out of the lower steam chamber 7 via the gas discharge port 3 once it has traveled along the tortuous path 12. The lower steam chamber inlet port 6 may be vertically above and in-line with hatch 13. Hatch 13 may be opened when visual inspection is required.

Additionally, in FIG. 4 the hole or notch 14 in baffle 9 is not shown. However, it should be understood that the hole or notch 14 may direct the flashed black liquor collected within the lower steam chamber 7 to the internal reclamation conduit 11. The flashed black liquor may pass through the hole or notch 14 of each baffle and flow into the internal reclamation conduit 11. Furthermore, it should be understood that the angled floor or base 10 may also direct the flashed black liquor toward the internal reclamation conduit 11.

FIG. 4 also depicts a top-down view of the internal reclamation conduit 11, which is also located within the angled floor or base 10 of the steam chamber 4 and the steam inlet port 5.

It is to be understood that the present technology is by no means limited to the particular construction and method steps herein disclosed or shown in the drawings, but also comprises any modifications or equivalents within the scope of the claims known in the art. It will be appreciated by those skilled in the art that the devices and methods herein disclosed will find utility with respect to multiple vessels for flash-evaporation of similar capabilities as disclosed in the examples of the present technology.

What is claimed is:

1. A flash tank comprising:

at least one wall defining a rounded interior chamber bounded by a top elliptical head opposite to a bottom elliptical head;

an inlet nozzle operatively engaged to the rounded interior chamber;

a vortex breaker operatively engaged to the bottom elliptical head;

a liquid discharge port operatively engaged to the bottom elliptical head below a center of the vortex breaker;

a steam chamber comprising: a gas inlet nozzle, an upper steam chamber and a lower steam chamber contiguous with the upper steam chamber, wherein the upper steam chamber is operatively engaged to the bottom of the top elliptical head and the upper steam chamber engages a steam input port that communicates with the rounded interior chamber, the lower steam chamber comprising:

an area defining an open space between the upper steam chamber and the lower steam chamber, a plurality of partially overlapping baffles operatively engaged to at least one wall defining the lower steam chamber;

an angled floor operatively engaged to the at least one wall defining the bottom of the lower steam chamber;

a conduit with a first end engaged to the angled floor and a second end engaged to the vortex breaker;

a gas discharge port operatively engaged to the lower steam chamber; and a hatch operatively engaged to the angled floor defining the bottom of the lower steam chamber.

2. The flash tank of claim 1 wherein the plurality of partially overlapping baffles are annularly arranged within the lower steam chamber.

3. The flash tank of claim 1 wherein the length of the plurality of the partially overlapping baffles is between 50 percent and 90 percent of the annular steam flow passage area of the lower steam chamber.

4. The flash tank of claim 2 wherein the plurality of partially overlapping baffles are annularly arranged along opposing walls of the lower steam chamber.

5. The flash tank of claim 1 wherein a steam chamber operatively engaged to the roof of the flash tank is disengaged from the flash tank's inner walls.

6. A steam chamber operatively engaged to a roof of a flash tank comprising:

a steam input port that accepts flash-evaporated steam from the flash tank, an upper steam chamber that directs steam from the input port through an opening into a lower steam chamber, wherein the lower steam chamber defines an annular space containing overlapping baffles creating a tortuous path for an exiting steam, the exiting steam exits through a gas discharge port after passing through the tortuous path, and the lower steam chamber contains an angled floor to permit the collection of condensed steam and a conduit directing re-condensed liquid from the steam chamber to a level of liquid at the bottom of the flash tank for discharge through the liquid discharge port.

7. The steam chamber of claim 6 wherein the walls of the steam chamber is recessed from the walls of the flash tank.

8. A method of flash-evaporating a high pressure liquid steam comprising:

introducing the high pressure liquid stream to a pressurized vessel, the pressurized vessel having a lower pressure than the high pressure liquid stream;

as the high pressure liquid stream enters the pressurized vessel, a steam stream and a flashed liquid stream is formed, wherein the steam stream enters a tortuous path caused by overlapping baffles increasing the amount of time volatile chemicals are exposed to the low pressure environment of the pressurized vessel thereby increasing the amount of volatile chemical evaporated from the high pressure liquid stream, after passing through the tortuous path caused by overlapping baffles, the steam stream exits the pressurized vessel through the gas discharge port, and the flashed liquid is discharged from the flash tank through the liquid discharge port.

9. The method of claim 8 wherein the high pressure liquid stream entering the pressurized vessel is high pressure black liquor from a pulping process.

10. The method of claim 8 wherein the flashed liquid stream contains condensed volatile chemicals and re-condensed liquid from a steam chamber within the pressurized vessel.

11. The method of claim 10 wherein the flashed liquid stream contains entrained droplets of liquor from the steam stream.

12. The method of claim 8 wherein the pressurized vessel is a flash tank.

13. A flash tank comprising:

an interior chamber defined by at least one wall;

a steam chamber supported within the interior chamber, said steam chamber separated from the at least one wall by a distance;

a steam inlet port to direct gas from the interior chamber into the steam chamber; and a gas discharge port to discharge gas from the steam chamber.

14. The flash tank of claim 13 wherein said steam chamber comprises an upper steam chamber, a lower steam chamber, a partition to separate the upper steam chamber and the lower steam chamber, and a lower steam chamber inlet port in the partition to allow gas to flow from the upper steam chamber to the lower steam chamber.

15. The flash tank of claim 14 wherein said steam inlet port connects the interior chamber to the upper steam chamber.

16. The flash tank of claim 15 wherein said gas discharge port is connected to the lower steam chamber to discharge gas from the steam chamber.

17. The flash tank of claim 16 wherein said lower steam chamber defines a path between the lower steam chamber inlet port and the gas discharge port.

18. The flash tank of claim 17 wherein said lower steam chamber comprises a plurality of baffles, each of said plurality of baffles extending into the path at least half of a width of the path.

19. The flash tank of claim 18 wherein each of said plurality of baffles extending into the path up to ninety percent of the width of the path.

20. The flash tank of claim 19 wherein said plurality of baffles are arranged annularly within the lower steam chamber.

21. The flash tank of claim 20 wherein said path is defined by opposing walls of the lower steam chamber and said plurality of baffles extend from the opposing walls in an alternating pattern.

22. The flash tank of claim 14 wherein said lower steam chamber comprises an angled floor.

23. The flash tank of claim 22 wherein said lower steam chamber comprises a hatch located on the angled floor.

24. The flash tank of claim 23 comprising a conduit having a first end in communication with the angled floor of the lower steam chamber.

25. The flash tank of claim 24 wherein at least one of said plurality of baffles is attached to the lower steam chamber inlet port, each having at least one hole and/or notch to allow fluid communication therethrough to the first end of the conduit.

* * * * *